US006162307A

United States Patent [19]

Hasegawa et al.

[11] Patent Number: 6,162,307

[45] Date of Patent: Dec. 19, 2000

[54] BN-PRECIPITATION-STRENGTHENED LOW-CARBON-FERRITIC HEAT-RESISTANT STEEL EXCELLENT IN WELDABILITY

[75] Inventors: Yasushi Hasegawa; Taro Muraki, both of Futtsu, Japan

[73] Assignee: Nippon Steel Corporation, Tokyo, Japan

[21] Appl. No.: 09/423,836

[22] PCT Filed: Mar. 12, 1999

[86] PCT No.: PCT/JP99/01226

§ 371 Date: Nov. 12, 1999

§ 102(e) Date: Nov. 12, 1999

[87] PCT Pub. No.: WO99/46419

PCT Pub. Date: Sep. 16, 1999

[30] Foreign Application Priority Data

Mar. 13, 1998 [JP] Japan ..... 10-063344

[51] Int. Cl.[7] ..... C22C 38/22; C22C 38/28; C21D 7/13

[52] U.S. Cl. ..... 148/334; 148/328; 148/648; 148/649; 148/654

[58] Field of Search ..... 420/106, 110; 148/334, 328, 648, 649, 654

[56] References Cited

FOREIGN PATENT DOCUMENTS

| | | |
|---|---|---|
| 61-231139 | 10/1986 | Japan . |
| 62-297435 | 12/1987 | Japan . |
| 63-18037 | 1/1988 | Japan . |
| 63-89644 | 4/1988 | Japan . |
| 4-268040 | 9/1992 | Japan . |
| 6-2926 | 1/1994 | Japan . |
| 6-2927 | 1/1994 | Japan . |
| 8-134584 | 5/1996 | Japan . |
| 9-104946 | 4/1997 | Japan . |

*Primary Examiner*—Deborah Yee
*Attorney, Agent, or Firm*—Kenyon & Kenyon

[57] ABSTRACT

This invention provides a ferritic heat-resistant steel that can improve HAZ softening resistance, can omit heat-treatment after welding and can reduce the construction cost of a power generation plant. This ferritic heat-resistant steel contains C: 0.01 to 0.06%, Si: 0.02 to 0.80%, Mn: 0.20 to 1.50%, Cr: 0.50 to 3.00%, Mo: 0.01 to 1.50%, W: 0.01 to 3.50%, V: 0.02 to 1.00%, Nb: 0.01 to 0.50%, N: 0.001 to 0.06%, B: 0.0003 to 0.008%, Ti: 0.001 to 0.5%, Zr: 0.001 to 0.5%, or containing one of Cu: 0.1 to 2.0%, Ni: 0.1 to 2.0% and Co: 0.1 to 2.0% either individually or in combination, and limiting P to not greater than 0.030%, S to not greater than 0.010% and O to not greater than 0.020%, wherein a weight ratio of TiN and BN in the steel is controlled to 1 to 100 in terms of a value (TiN+ZrN %)/(BN %), and a mean grain diameter of BN is not greater than 1 $\mu$m.

4 Claims, 6 Drawing Sheets

FIG. 1(a)
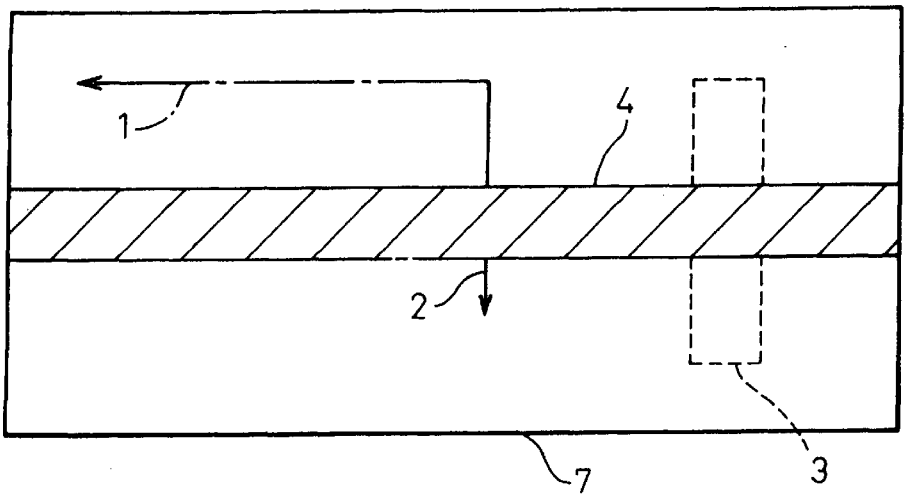
FIG. 1(b)
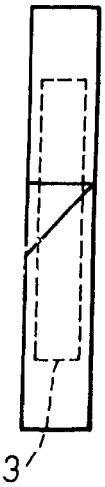
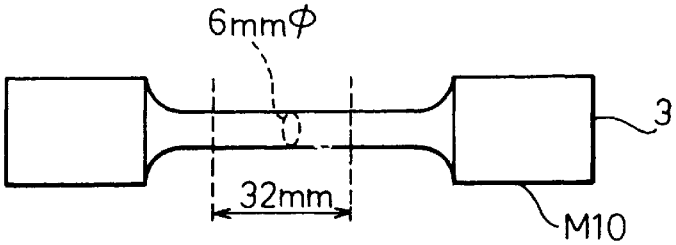
FIG. 1(c)
FIG. 2
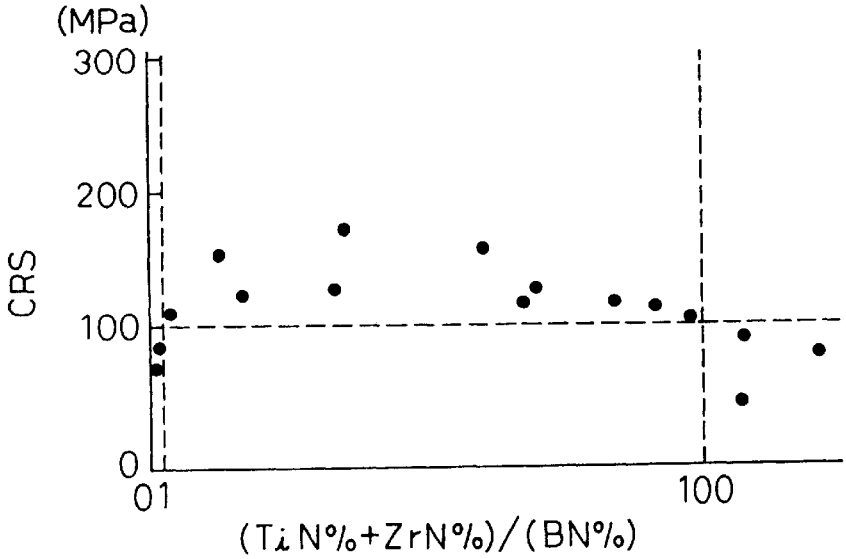

BN-PRECIPITATION-STRENGTHENED LOW-CARBON-FERRITIC HEAT-RESISTANT STEEL EXCELLENT IN WELDABILITY

TECHNICAL FIELD

This invention relates to ferritic heat resistant steel. More particularly, it relates to a ferritic heat-resistant steel that is excellent in creep rupture strength when used in a high temperature high-pressure environment, is excellent also in HAZ softening resistance, and can omit heat-treatment after welding.

BACKGROUND ART

Recently, temperatures and pressures in thermal power-plant boilers have been elevated remarkably. Operation at 566° C. and 316 bar is planned for some plants, and future operating condition of up to 649° C. and 352 bar is expected. Thus, the requirements for the plant materials have become more severer.

The heat-resistant materials used for thermal power plants are exposed to different environments depending on the portions at which the materials are employed. Materials having high corrosion resistance and strength at high temperatures, typified by austenite type materials, are used for portions exposed to a high atmospheric temperatures such as so-called "superheater pipes" and "reheater pipes", while martensite type materials containing 9 to 12% of Cr are used for portions where excellent steam oxidation resistance and thermal conductivity are required.

Recently, novel heat-resistant materials that contain W in order to improve the high temperature strength have been developed and put into practical application, and have made great contributions to the achievement of higher efficiency in power generation plants. For example, Japanese Unexamined Patent Publication (Kokai) Nos. 63-89644, 61-231139 and 62-297435 describe ferritic heat-resistant steels capable of achieving much higher creep strength in comparison with Mo-addition type ferrite steels according to the prior art by using W as a solid solution strengthening element. Most of these materials have a structure of a tempered martensite single phase, and are expected to be used, as the materials of the next generation, in a high temperature/high pressure environments due to superiority of steam oxidation resistance in combination with high strength of the ferrite steel.

As higher temperature and higher pressure have been achieved in the thermal power plants, severe operating conditions have been imposed on those portions which have so far been exposed to relatively low temperatures and pressures, such as furnace wall pipes, economizers, steam generators, main steam pipes, and so forth. In consequence, the application of low Cr ferritic heat-resistant steels stipulated by the industrial standard, such as so-called 1.25 Cr steel and 2.25 Cr steel, has become gradually impossible.

To cope with such a trend, a large number of steels that have improved the high temperature strength by positive addition W or Mo, have been proposed for such low strength materials, too.

Japanese Unexamined Patent Publication (Kokai) Nos. 63-18038 and 4-2680040 and Japanese Examined Patent Publication (Kokoku) Nos. 6-2926 and 6-2927 propose 1% to 3% Cr-containing steels that contain W as a principal strengthening element and have improved high temperature strength. All of them have higher high-temperature strength than the conventional low Cr containing steels.

On the other hand, the ferritic heat-resistant materials utilize a property of the steel in that the phase transformation from the austenite single phase region to the ferrite+carbide precipitation phase, that occurs with cooling at the time of heat-treatment, exhibits a super-cooling phenomenon. These materials utilize also the high strength of the resulting martensite or bainite structure involving large quantities of transition, or its tempered structure. Therefore, when this structure receives the thermal history such that it is again heated back to the austenite single phase region, such as when it is affected by welding heat, the high density transition is again released. In consequence, the drop of strength occurs locally in the welding heat affected zone. Among the portions re-heated to a temperature higher than the ferrite-austenite transformation point, the portions heated to a temperature near the transformation point, such as 800 to 900° C. in the case of 2.25% Cr steel, and again cooled within a short period of time, undergo again the martensite transformation or the bainite transformation and change to a fine grain structure before the austenite crystal grains grow sufficiently. Moreover, $M_{23}C_6$ type carbide, that is the principal factor for improving the material strength by precipitation strengthening, does not undergo re-solid solution, but its constituent components are denatured or get coarsened. These mechanisms inviting the drop of the high temperature strength operate in complex ways and sometimes cause a locally softened zone. This softened zone generation phenomenon will be hereinafter referred to "HAZ softening" for convenience.

The inventors of the present invention have conducted intensive studies on the softened zone, and have found that the drop of the strength results mainly from the change of the constituent elements of the $M_{23}C_6$ type carbide. As a result of further studies, the present inventors have found that large quantities of Mo or W, as the indispensable element for solid solution strengthening of the high strength martensite type heat-resistant steel, in particular, undergo solid solution into the constituent metal element M in $M_{23}C_6$ while they are being affected by the welding heat, and precipitate on the crystal grain boundary of the structure which is converted to the fine grain structure. As a result, a Mo- or W-lean phase is generated in the proximity of the austenite grain boundary and results in the local drop of the creep strength.

Therefore, the drop of the creep strength due to the influence of welding heat is critical for the heat-resistant materials, and it is obvious that the prior art technology such as optimization of heat-treatment and a welding process cannot fundamentally solve this problem. Moreover, the application of counter-measure by converting again the weld portion to the complete austentie, that is believed to be the only solution, is obviously impossible in view of the construction process of the thermal power plants. It is also obvious that the "HAZ softening" phenomenon is quite unavoidable in the heat-resistant martensite steels or ferrite steels according to the prior art.

Notwithstanding the fact that the novel low Cr ferritic heat-resistant steel containing W or Mo has a high base metal strength, a drop in strength to a maximum of 30% occurs in the welding heat affected zone in comparison with the base metal. Therefore, this material has been regarded as the material having a small effect of improving locally the strength for the conventional materials. In Japanese Unexamined Patent Publication (Kokai) No. 8-134584, the present inventors have proposed a high strength ferritic heat-resistant steel excellent in HAZ softening resistance and a method of producing the steel. The steel according to this previous patent application contains, in terms of mass %, 0.01 to 0.30% of C, 0.02 to 0.80% of Si, 0.20 to 1.50% of Mn, 0.50 to less than 5.00% of Cr, 0.01 to 1.50% of Mo, 0.01 to 3.50% of W, 0.02 to 1.00% of V, 0.01 to 0.50% of Nb, 0.001 to 0.06% of N, at least one of 0.001 to 0.8% of Ti and 0.001 to 0.8% of Zr either alone or in combination, limits P, S and O to not greater than 0.030%, not greater than 0.010% and not greater than 0.020%, respectively, or contains at least one of 0.2 to 5.0% of Co and 0.2 to 5.0% of Ni, and the balance consisting of Fe and unavoidable impurities, wherein the value of (Ti % + Zr %) in metal components M of a $M_{23}C_6$ type carbide existing in the steel is 5 to 65. The production method of a high strength ferritic heat-resistant steel excellent in HAZ softening resistance comprises adding Ti and Zr to the steel in the course of 10 minutes immediately before tapping so that the value (Ti % + Zr %) in the metal component M in the $M_{23}C_6$ type carbide existing in the steel becomes 5 to 65, temporarily stopping cooling at a temperature within the range of 880 to 930° C. after solid-solution heat-treatment, and holding the steel at the same temperature for 5 to 60 minutes.

As the demand for electric power has been increasing in recent years, however, not only the power industry but also business companies in different business fields have now been granted to carry on a power business so long as they have power generation and supply setups. Thus, the principle of competition has been introduced into the power supply business. As a large number of power generation setups have thus been built up, the price competition of power has been introduced into the power business companies, and the reduction of the cost of construction of the power generation plants has become all the more important. The improvement of the strength of the boiler materials will result in the reduction of the thickness of heat-exchangers, and so forth, and contributes to the reduction of the material cost. In working and assembly processes of the materials, a reduction of the number of process steps or shortening of the process has been desired. In the case of the ferritic heat-resistant steel used particularly for those portions of the setups which bear a relatively low pressure load, the materials which can omit the heat-treatment after welding (hereinafter referred to as "PWHT" (Post Weld Heat-Treatment), that would otherwise require a long time and a high expense, have been needed because the strength of the materials themselves is relatively low.

However, a higher strength of the material is contradictory to omission of the pre- and post-weld heat-treatment, and omission of the heat-treatment in joints made of a material having a high strength is extremely difficult to attain from the aspect of hardenability. Lowering of the strength of the HAZ results also in the promotion of HAZ softening resistance. For these reasons, it has been believed to be impossible in the past to accomplish a technology, for reducing the power plant construction cost, that can simultaneously satisfy the improvement of the material strength, the improvement of the HAZ softening resistance and omission of the PWHT.

DISCLOSURE OF THE INVENTION

In order to satisfy the needs for the construction of a large number of power generation plants resulting from the increase of the demand for electric power, the present invention aims at reducing the material and machining costs as the installation cost, achieving the improvement of the material strength, improving the HAZ softening resistance and omitting the PWHT as the problems of the prior art, and accomplishing the reduction of the construction cost of the power generation plants.

The present invention provides a novel ferritic heat-resistant steel and a method of producing the same, by employing the following measures. The improvement of the creep strength is achieved by sold-solution strengthening by W or Mo, and the HAZ softening resistance is improved by keeping the precipitation/strengthening function of TiN or ZrN for the HAZ. The post-welding heat-treatment (PWHT) is omitted by limiting the C content to 0.06% or below, and the material strength lost by the reduction of the C content is recovered afresh by BN precipitation. Moreover, in order to avoid the occurrence of precipitation brittleness due to BN, a (TiN % + ZrN %)/(BN %) weight ratio in the steel is controlled by adjusting the chemical components and the temperature of hot rolling or hot forging, and BN coarsening precipitation is prevented by controlling a subsequent cooling rate.

The present invention provides ferritic heat-resistant steel excellent in HAZ softening resistance and capable of omitting heat-treatment after welding, containing, in terms of mass %, 0.01 to 0.06% of C, 0.02 to 0.80% of Si, 0.20 to 1.50% of Mn, 0.50 to 3.00% of Cr, 0.01 to 1.50% of Mo, 0.01 to 3.50% of W, 0.02 to 1.00% of V, 0.01 to 0.50% of Nb, 0.001 to 006% of N, 0.0003 to 0.008% of B, 0.001 to 0.5% of Ti, 0.001 to 0.5% of Zr, or containing further at least one of 0.1 to 2.0% of Cu, 0.1 to 2.0% of Ni and 0.1 to 2.0% of Co either alone or in combination, limiting P, S and O to not greater than 0.030%, to not greater than 0.010% and to not greater than 0.020%, respectively, and containing the balance consisting of Fe and unavoidable impurities, wherein a weight ratio of TiN and BN in the steel is controlled to 1 to 100 in terms of a value (TiN+ZrN %)/(BN %), and a mean grain diameter of BN is not greater than 1 $\mu$m.

The present invention provides also a method of producing ferritic heat-resistant steel excellent in HAZ softening resistance and capable of omitting heat-treatment after welding, which method comprises the steps of limiting a working ratio of hot rolling or hot forging to at least 50% when the steel having the chemical components described above is hot rolled or hot forged, finishing the hot working at a temperature between 900 and 1,000° C., and setting a cooling ratio immediately after the finish of hot working to 50 to 1,000° C. up to the bainite transformation finish temperature so that a weight ratio of TiN and BN in the steel is from 1 to 100 in terms of a value (TiN+ZrN %)/(BN %) and the mean grain diameter of BN is not greater than 1 $\mu$m.

Hereinafter, the reasons for limitation in the present invention will be explained in detail.

First, the reasons of each component range described above will be explained.

Carbon (C) is necessary for keeping the strength. If it is less than 0.01%, however, the strength cannot be secured sufficiently, and if it exceeds 0.06%, the weld bond portion becomes extremely hard, and the original object of the present invention, that is, the omission of heat-treatment after welding, cannot be accomplished. Therefore, the range of C is limited to 0.01 to 0.06%.

Silicon (Si) is the element that is important to secure the oxidation resistance, and is necessary as a deoxidizer. If its content is less than 0.02%, the deoxidation effect is not sufficient and if it exceeds 0.80%, the creep strength is lowered. Therefore, the Si content is limited to the range of 0.02 to 0.80%.

Manganese (Mn) is a component that is necessary not only for deoxidation but also for keeping the strength. To obtain a sufficient effect, at least 0.20% of Mn must be added. When the Mn content exceeds 1.50%, the creep strength drops in some cases. Therefore, the Mn content is limited to the range of 0.20 to 1.50%.

Chromium (Cr) is an indispensable element for securing the oxidation resistance. At the same time, Cr combines with C and finely precipitates in the form of $Cr_{23}C_6$, $Cr_7C_3$, etc, in the base metal matrix, contributing thereby to the increase of the creep strength. The lower limit is set to 0.50% from the aspect of the oxidation resistance and the upper limit is set to less than 3.00% in order to secure sufficient hardenability at room temperature.

Tungsten (W) is the element that remarkably improves the creep strength through solid solution strengthening, and remarkably improves the creep strength for a long time particularly at high temperatures of 500° C. or more. If it is added in an amount exceeding 3.50%, however, large quantities of W precipitate as an inter-metallic compound with the grain boundary as the center, and remarkably lowers the base metal toughness and the creep strength. Therefore, the upper limit is set to 3.50%. If the W content is less than 0.01%, the effect of solid solution strengthening is not sufficient. Therefore, the lower limit is set to 0.01%.

Molybdenum (Mo), too, is the element that improves the high temperature strength through solid solution strengthening. If the Mo content is less 0.01%, the effect is not sufficient and if it exceeds 1.50%, Mo precipitates in large quantities in the form of $Mo_2C$ type carbide or in the form of Mo type inter-metallic compounds. When added simultaneously with W, Mo remarkably lowers the base metal toughness in some cases. For this reason, the upper limit is set to 1.50%.

Vanadium (V) is the element that remarkably improves the high temperature creep rupture strength of the steel both when it precipitates as the precipitate and when it undergoes solid solution in the matrix in the same way as W. If the V content is less than 0.02% in the present invention, precipitation strengthening by the V precipitate is not sufficient, and if it exceeds 1.00%, on the contrary, clusters of the V type carbides or carbon nitrides are generated, lowering thereby the toughness. Therefore, the range of the addition of V is limited to the range of 0.02 to 1.00%.

Niobium (Nb) precipitates as MX type carbides or carbon nitrides, improves the high temperature strength and contributes also to solid solution strengthening. If the Nb content is less than 0.01%, the effect of addition cannot be observed, and if it exceeds 0.50%, Nb precipitates as coarse precipitates and lowers the toughness. Therefore, the range of addition is limited to 0.01 to 0.50%.

Nitrogen (N) precipitates in the matrix as solid solution or nitrides or carbon nitrides, takes mainly the forms of VN, NbN or their carbon nitrides, and contributes to both solid solution strengthening and precipitation strengthening. In the present invention, N particularly combines with Ti or Zr or B and precipitates in the form of TiN or ZrN or BN, and contributes to the improvement of the HAZ softening resistance and the creep rupture strength. If the amount of addition of N is less than 0.001%, the contribution of N to strengthening hardly occurs. In view of the upper limit value of N, that can be added to the molten steel in accordance with the Cr addition amount, that is maximum 3.00%, the upper limit of N is set to 0.06%.

The addition of titanium (Ti) and zirconium (Zr) is essentially necessary in the present invention. The addition of these elements makes it possible to avoid "HAZ softening". In the component system of the steel according to the present invention, Ti and Zr have extremely high affinity with C, undergo solid solution in M as the constituent metal elements of $M_{23}C_6$ and raise the decomposition temperature of $M_{23}C_6$. Therefore, these elements are effective for preventing coarsening of $M_{23}C_6$ in the "HZ softening" zone. Moreover, they prevent solid solution of W and Mo into $M_{23}C_6$ and do not therefore generate the W— and Mo-lean phase around the precipitate. It has been found out that when added simultaneously, these two elements contribute to the higher improvement of the HAZ softening resistance than when they are added individually. Therefore, the present invention stipulates the simultaneous addition of these elements as the essential requirement. The effect can be observed from their minimum content of 0.001%. When they are individually added in the amount greater than 0.5%, they form coarse MX type carbides and deteriorate the toughness. Therefore, the range of the addition amount is limited to 0.001 to 0.5%.

The simultaneous addition of boron (B) with Ti, Zr and N constitutes the very root of the present invention. Generally, B does not easily undergo solid solution in the steel but exists in most cases in the form of borides in combination with the carbides. It is known generally that chemical affinity of BN is high and stable in the N-containing steel among various boron compounds. Because the precipitates that are thermodynamically stable sparingly undergo solid solution in the steel, on the contrary, the possibility is high that these precipitates, when they precipitate in the grain boundary, exist as large precipitates. The size of the precipitates at this time is the factor that exerts great influences particularly on the creep rupture strength in the heat-resistant materials. The present invention makes it possible to omit the heat-treatment after welding, thus shortening the welding process of the steel of the present invention, and contributing to the reduction of the working cost. In this instance, it is the feature of the present invention that the loss of the creep strength by this carbon content is supplemented by strengthening by the precipitation of BN formed by the addition of B. The precipitation form of BN is determined by chemical affinity of Ti and Zr with N and by chemical affinity of B and N. It is therefore most important in the present invention to prevent coarsening of BN by finely dispersing these elements by conducting rolling or forging under an appropriate condition, and further controlling the cooling condition. These working and heat-treatment conditions will be described later in detail. If the amount of addition of B is less than 0.0003%, BN does not precipitate and if it exceeds 0.008%, BN becomes coarse with the result of deterioration of both the strength and the toughness. Therefore, the B content is limited to the range of 0.0003 to 0.008%.

The elements described above are the principal constituent elements in the present invention. In addition to these elements, Cu, Ni and Co can be added depending on the intended application. These elements are necessary, and are useful, in order to obtain a hardened structure or a hardened/tempered structure particularly when large quantities of ferrite stabilizing elements, that is, Cr, W, Mo, Ti, Zr, Si, etc, are added. At the same time, Cu is effective for improving the high temperature corrosion resistance, Ni, for improving the toughness and Co, for improving the strength, respectively. If their content is not greater than 0.1%, the effect is not sufficient and if it exceeds 2.0%, precipitation of coarse inter-metallic compounds or brittleness resulting from their segregation to the grain boundary is not avoidable. Therefore, the range of addition is limited to 0.1 to 2.0%.

P (phosphorus), S (sulfur) and O (oxygen) mix as impurities in the steel of the present invention. P and S lower the strength, and O precipitates as oxides and decrease the toughness. In order to obtain the effect of the present invention, therefore, their upper limits are limited to 0.03%, 0.01% and 0.02%, respectively.

Incidentally, the present invention aims at providing the ferritic heat-resistant steel that is excellent in the creep rupture strength and the HAZ softening resistance and can omit the heat-treatment after welding. Therefore, a production method and heat-treatment suitable for the intended object can be conducted for the steel of the present invention and do not in any way hinder the effect of the present invention.

When the steel having the composition set forth in the appended claims 1 and 2 of the present invention is produced by an ordinary production process, the precipitation state of TiN, Zr and BN, in particular, must be controlled. The ferritic heat-resistant steel excellent in the creep rupture strength and in the HAZ softening resistance and capable of omitting heat-treatment after welding cannot be produced unless the production method set forth in the appended claims 3 and 4 of the present invention is employed. The production method described in claims 3 and 4 is determined by the following experiments.

Steels having the chemical components described in claims 1 and 2 of the present invention are produced by vacuum melting or by using an electric furnace, and are cast into ingots of 20 kg, 50 kg, 300 kg, 2 tons and 10 tons. After a scale on the surface is removed, each of the steels so cast is heated to 1,150° C., and hot rolling or hot forging is finished at each temperature of 850, 920, 950, 980, 1,020, 1,050 and 1,100° C., giving slabs having thickness of 15, 50 and 100 mm. After working, the cooling rate is changed from 10° C./hr to maximum 1,500° C./hr so as to examine the influences of the cooling condition after hot working. Furthermore, these slabs are subjected to dehydrogenation annealing at 700° C. for 5 hours, and solid solution heat-treatment was carried out at 920 to 1,050° C. for 10 to 180 minutes. Thereafter, the slabs are subjected to hardening with water, hardening with oil and compulsive air cooling or gradual cooling while being left standing to form the bainite or bainite-ferrite structure. Tempering is carried out by re-heating to 700° C. for 30 to 120 minutes. Analysis specimens are collected from the slabs, and precipitate residues are extracted by acid dissolution. The amounts of Ti, Zr, N and B precipitated in the steel are then analyzed. Furthermore, thin film test specimens are prepared for the observation with an electron microscope, and the forms of the precipitates are analyzed. In order to examine the forms of these precipitates and the influences of the precipitate compositions on the creep characteristics, creep rupture test specimens are collected, and the creep rupture tests up to 10,000 hours were carried out at 500° C. and 600° C. Linear extrapolation is conducted by eye to determine the creep rupture strength with reference to the estimated creep rupture strength at 500° C. for 100,000 hours by the Larson-Millar method, and the values so obtained are used as typical values of the high temperature strength.

The slabs are further processed into welding test specimens (45-degree single bevel groove) in accordance with the thickness, and are welded using an eutectic welding material. Each creep rupture test specimen 3 is collected from a direction 2 orthogonal to the direction of the weld line 1 so that the weld portion is contained in the parallel portion of the test specimen. The creep rupture strength of its joint portion is measured, and the HAZ softening resistance is evaluated by comparison with the creep rupture strength of the base metal. The measured length of the parallel portion of the creep rupture test specimen is 30 mm and the diameter is 6 mm. The welding heat input is 15,000 J/cm$^2$. The hardness of each of the weld metal, the HAZ and the base metal is measured, and whether or not the heat-treatment after welding can be omitted is examined.

FIG. 2 is a graph showing the relationship between the value (TiN % +ZrN %)/(BN %) and the estimated creep rupture strength at 500° C. for 100,000 hours. It can be understood from FIG. 2 that the creep rupture strength of the ferritic heat-resistant steel according to the present invention can be increased to a target value of at least 100 MPa by controlling the value (TiN % +ZrN %)/(BN %) to the range of 1 to 100. FIG. 3 is a graph showing the relationship between the finish temperature of hot rolling or forging and the value (TiN % +ZrN %)/(BN %). It can be understood from this graph that in order to control the value (TiN % +ZrN %)/(BN %) to 1 to 100, the finish temperature of hot rolling or hot forging must be controlled to 900 to 1,000° C. FIG. 4 is a graph showing the relationship between the mean grain diameter observed through the electron microscope and the cooling rate after hot working. The diameter of the precipitate affects the creep rupture strength. In the steel having the chemical composition stipulated by the present invention, the improvement effect of the creep rupture strength cannot be obtained unless the grain diameter is not greater than 1 $\mu$m. FIG. 4 demonstrates that in order to prevent the mean grain diameter of BN from dropping below 1 $\mu$m, the cooling rate after working must be at least 50° C./hr. When the cooling rate exceeds 1,000° C., however, the grain diameter of BN is small, it is true, but all the materials undergo firing cracks due to the volume change during the bainite transformation resulting from drastic cooling, thereby forming a large number of cracks in the slab. For this reason, the upper limit of the cooling rate is set to 1,000° C./hr so as to maintain soundness of the slab. FIG. 5 is a graph showing the relationship between a so-called "working ratio", that represents, as a percent fraction, a ratio of the sectional area of the slab at the start of hot rolling or hot forging to the sectional area of the slab after completion of such a working, and the mean grain diameter of BN. The precipitation sites must exist sufficiently in order for the precipitates to disperse finely. FIG. 5 illustrates that even when the cooling rate is great after working, fine dispersion of BN cannot be accomplished unless the working ratio is at least 50%.

It can be understood from the experimental data given above that in order to control the weight ratio of TiN and BN in the steel having the composition of the present invention to 1 to 100 in terms of the value (TiN +ZrN %)/(BN %), it is essentially necessary to set the working ratio of hot rolling or forging to at least 50%, to finish working at a temperature between 900 and 1,000° C. and to set the cooling rate immediately after working to 50° C./hr to 1,000° C./hr until the bainite transformation finish temperature. The present inventors have found that the mean grain diameter of the precipitate of BN at this time is not greater than 1 $\mu$m, and the estimated creep rupture strength of the steel at 500° C. is stably at least 100 MPa. The present inventors have thus decided the production method of the steel. It is thus obvious that even when the steel has the chemical composition as stipulated in the present invention, the steel that is excellent in the high creep rupture strength and the HAZ softening resistance and that can omit the heat-treatment after welding cannot be obtained unless the production conditions described above are satisfied.

The melting method of the steel of the present invention is not at all limited, and a melting process to be used may be determined in accordance with the chemical components of the steel and the production cost, by using a converter, an induction heating furnace, an arc melting furnace, an electric furnace, and so forth. An Ar gas bubbling apparatus, an LF equipped with an arc heater or plasma heater, or a vacuum degassing treatment apparatus, can be applied advantageously, and these apparatuses further improve the effects of the present invention. A solid solution heat-treatment is essentially necessary in the subsequent rolling process, or in a pipe making rolling process for producing a steel pipe, in order to achieve again uniform solid solution of the precipitates other than TiN, ZrN and BN. Those other production processes, which are believed necessary or useful for producing the steel or the steel product of the present invention, such as rolling, heat-treatment, pipe making, welding, cutting, inspection, and so forth, can be applied in the present invention, and they do not in any way hinder the effects of the present invention.

As the production process of the steel pipe, in particular, it is possible to employ a method of producing a seamless pipe and tube by changing the slab into a round billet or a square billet and conducting hot extrusion or various seamless rolling process, a method of producing an electric resistance welded steel pipe by conducting hot rolling and cold rolling of a thin sheet and conducting electric resistance welding, and a method of producing a weld steel pipe by conducting TIG, MIG, SAW, LASER and EB, either individually or in combination, provided that the production process of the present invention is essentially contained. It is further possible to apply hot- or warm-SR (squeeze rolling) or sizing rolling, or various correction steps after each of the methods described above. In this way, the range of the application of the steel of the present invention can be expanded.

The steel according to the present invention can be provided in the form of a thick sheet and a thin sheet, and can be used in various forms of heat-resistant materials by applying necessary heat-treatment to the sheet. Such heat-treated steel sheets do not at all affect adversely the effects of the present invention.

Furthermore, HIP (Hot Isohydrostatic Press molding apparatus), CIP (Cold Isohydrostatic Press molding apparatus, a powder metallurgical method such as sintering, etc, can also be applied, and products having various shapes can be obtained by conducting a necessary heat-treatment after the forming treatment.

The steel pipes, the sheets and the heat-resistant members having various shaped described above can be heat-treated in various ways in accordance with the intended objects and applications, and such heat-treatments are also important in order to fully exploit the effects of the present invention.

Products are produced in most cases through annealing (solid solution heat-treatment)+tempering. Re-tempering and re-annealing can be further applied either individually or in combination, and they are useful, too. However, management of the stop temperature of hot working and the cooling rate after the hot working is essentially necessary.

When the nitrogen or carbon content is relatively high, and when the austenite stabilizing elements such as Co and Ni are relatively great or when the Cr equivalent becomes small, a so-called "sub-zero treatment", that executes cooling below 0° C. so as to avoid the residual austenite phase, can be applied, and such a treatment is effective for sufficiently obtaining the mechanical properties of the steel of the present invention.

Each of the process steps can be applied repeatedly within the range in which the material characteristics can be exhibited sufficiently, and they do not adversely affect the effects of the present invention.

The process steps described above can be suitably selected and applied to the production process of the steel according to the present invention.

BRIEF DESCRIPTION OF THE DRAWINGS

FIGS. 1(*a*), 1(*b*) and 1(*c*) show a weld joint according to the present invention, its groove shape and a shape of a creep rupture test specimen.

FIG. 2 is a graph showing the relation between a 100,000-hour estimated creep rupture strength CRS and a value (TiN % +ZrN %)/(BN %) in the present invention.

BEST MODE FOR CARRYING OUT THE INVENTION

Figure 3:
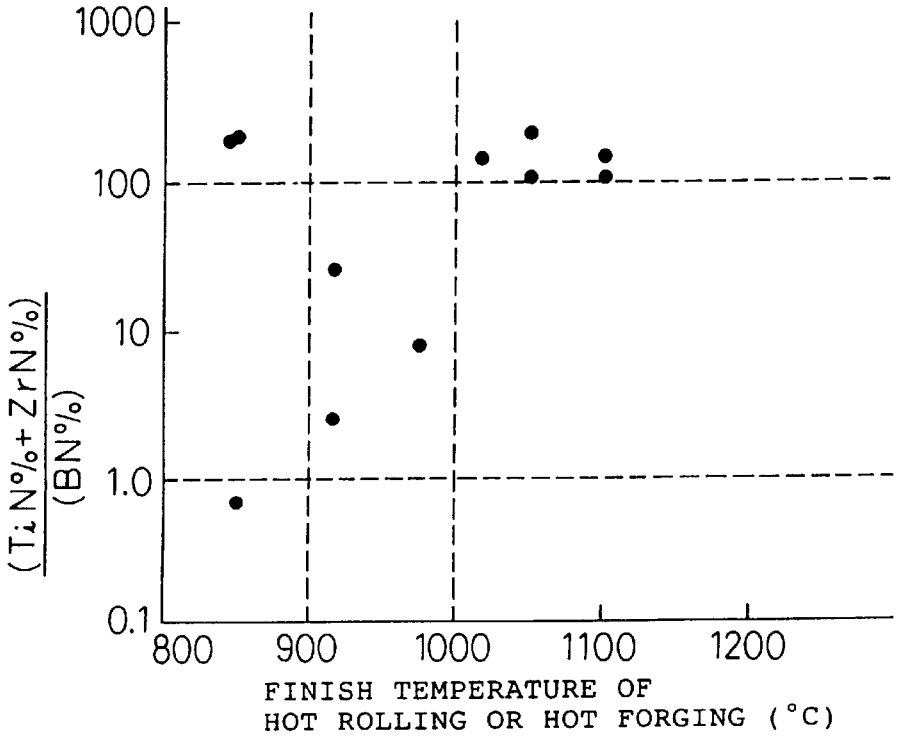
FIG. 3 is a graph showing the relation between a hot rolling finish temperature or a hot forging finish temperature and the value (TiN % +ZrN %)/(BN %) in the present invention.
Figure 4:
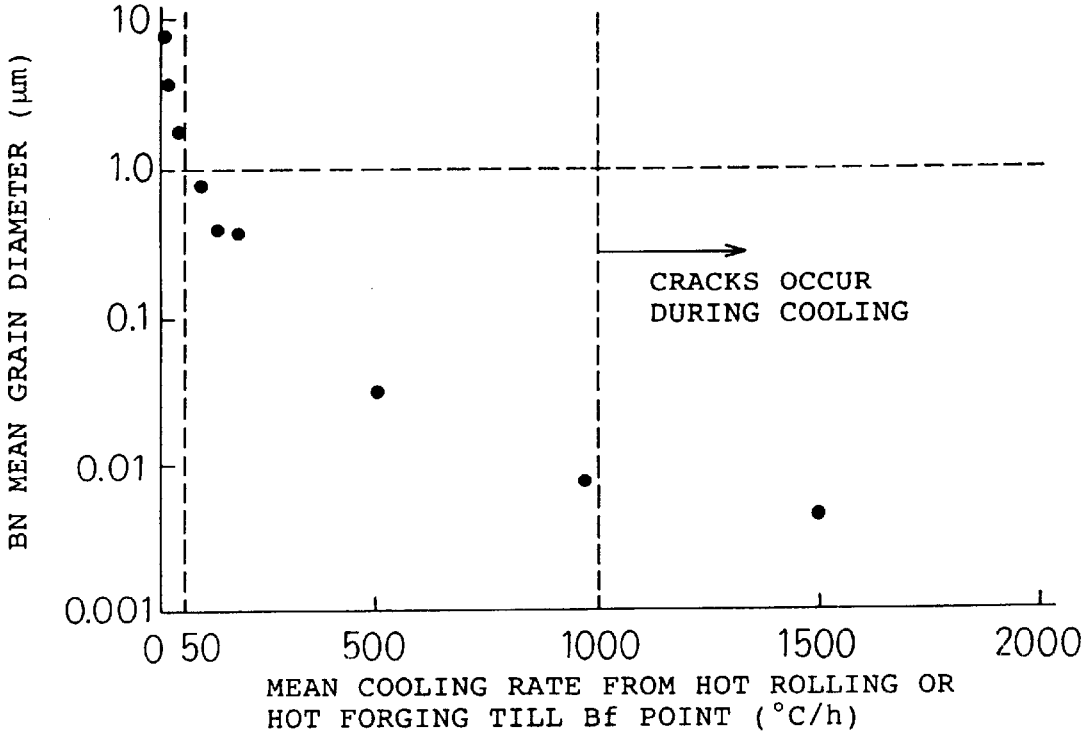
FIG. 4 is a graph showing the relation between a mean cooling rate (C/hr) from the finish of hot rolling or forging to a Bf point and a mean grain diameter of BN.
Figure 5:
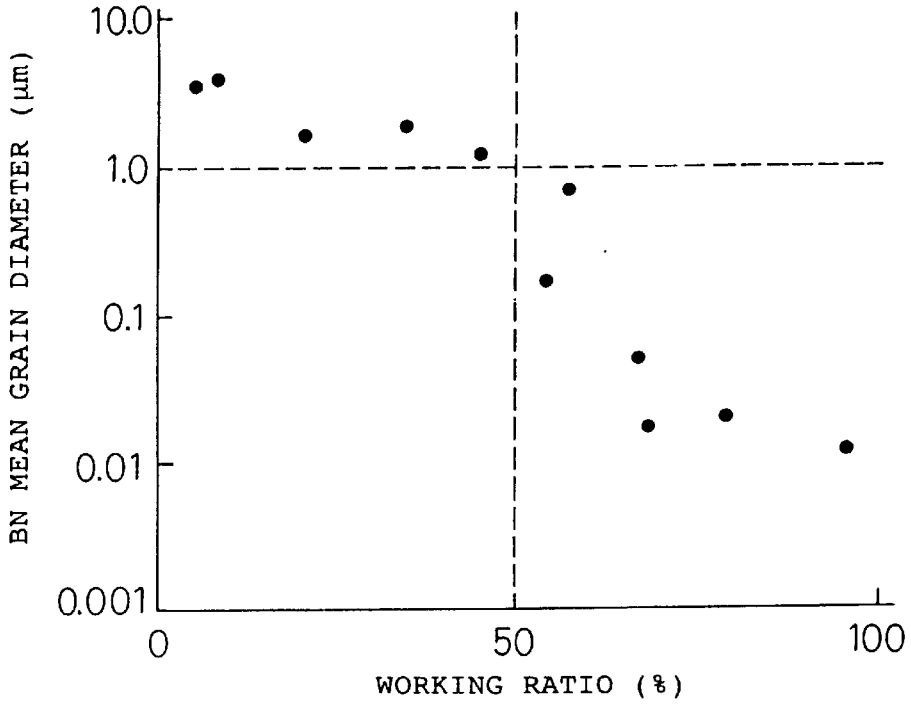
FIG. 5 is a graph showing the relation between the mean grain diameter of BN and a hot working ratio in the present invention.

Next, the best mode for carrying out the present invention will be explained with reference to examples thereof.

[EXAMPLES]

<Example 1>

As Examples of the present invention, 20 tons, 2 tons, 300 kg, 100 kg and 50 kg of steels having the compositions of claims 1 and 2 of the Scope of Claim of the Patent, tabulated in Tables 1 and 2, were molten by ordinary blast furnace-converter blowing, VIM, EF, or a laboratory vacuum melting apparatus, and were refined into slabs by LF equipment having an arc re-heating means and capable of blowing Ar, or by compact reproduction testing equipment having a capacity equivalent to the former.

TABLE 1

| No. | C | Si | Mn | Cr | Mo | W | V | Nb | N | B | Ti |
|---|---|---|---|---|---|---|---|---|---|---|---|
| 1 | 0.023 | 0.75 | 0.497 | 2.378 | 1.466 | 0.922 | 0.074 | 0.384 | 0.012 | 0.0061 | 0.331 |
| 2 | 0.033 | 0.49 | 1.477 | 1.981 | 1.008 | 0.185 | 0.887 | 0.490 | 0.053 | 0.0049 | 0.036 |
| 3 | 0.056 | 0.70 | 0.652 | 1.199 | 0.056 | 1.848 | 0.514 | 0.310 | 0.003 | 0.0056 | 0.436 |
| 4 | 0.021 | 0.25 | 0.790 | 2.989 | 0.477 | 2.279 | 0.675 | 0.321 | 0.032 | 0.0055 | 0.049 |
| 5 | 0.011 | 0.55 | 0.817 | 2.665 | 0.577 | 2.576 | 0.162 | 0.354 | 0.053 | 0.0025 | 0.243 |
| 6 | 0.040 | 0.43 | 1.283 | 1.917 | 1.103 | 3.124 | 0.977 | 0.482 | 0.054 | 0.0007 | 0.284 |
| 7 | 0.033 | 0.24 | 0.899 | 2.940 | 1.284 | 3.187 | 0.141 | 0.418 | 0.010 | 0.0067 | 0.207 |
| 8 | 0.027 | 0.04 | 1.263 | 1.705 | 0.181 | 0.967 | 0.529 | 0.028 | 0.030 | 0.0026 | 0.127 |
| 9 | 0.032 | 0.77 | 0.202 | 1.979 | 1.204 | 0.403 | 0.741 | 0.289 | 0.031 | 0.0078 | 0.046 |
| 10 | 0.052 | 0.29 | 0.979 | 2.262 | 0.882 | 0.768 | 0.394 | 0.256 | 0.045 | 0.0038 | 0.302 |
| 11 | 0.025 | 0.58 | 1.440 | 0.701 | 1.072 | 1.323 | 0.233 | 0.163 | 0.024 | 0.0011 | 0.226 |
| 12 | 0.011 | 0.07 | 0.848 | 0.856 | 0.486 | 1.913 | 0.883 | 0.020 | 0.020 | 0.0063 | 0.340 |
| 13 | 0.023 | 0.62 | 0.708 | 1.581 | 0.489 | 1.622 | 0.671 | 0.405 | 0.020 | 0.0079 | 0.161 |
| 14 | 0.041 | 0.66 | 0.316 | 1.540 | 0.832 | 3.283 | 0.151 | 0.018 | 0.042 | 0.0003 | 0.006 |
| 15 | 0.054 | 0.78 | 0.418 | 2.964 | 0.065 | 2.262 | 0.734 | 0.400 | 0.003 | 0.0019 | 0.018 |
| 16 | 0.029 | 0.05 | 0.854 | 1.557 | 1.237 | 1.011 | 0.358 | 0.285 | 0.031 | 0.0043 | 0.276 |
| 17 | 0.048 | 0.47 | 0.882 | 1.842 | 1.204 | 1.911 | 0.687 | 0.444 | 0.027 | 0.0005 | 0.053 |
| 18 | 0.037 | 0.78 | 1.302 | 1.330 | 0.062 | 2.165 | 0.843 | 0.164 | 0.027 | 0.0015 | 0.432 |
| 19 | 0.033 | 0.79 | 1.486 | 2.231 | 0.638 | 1.714 | 0.599 | 0.360 | 0.056 | 0.0048 | 0.321 |
| 20 | 0.023 | 0.33 | 0.253 | 0.757 | 0.835 | 3.001 | 0.713 | 0.320 | 0.015 | 0.0072 | 0.069 |
| 21 | 0.058 | 0.23 | 0.902 | 1.429 | 1.267 | 1.695 | 0.607 | 0.064 | 0.008 | 0.0035 | 0.278 |
| 22 | 0.011 | 0.18 | 0.390 | 2.234 | 0.911 | 1.256 | 0.331 | 0.427 | 0.055 | 0.0028 | 0.433 |
| 23 | 0.032 | 0.59 | 0.516 | 0.894 | 1.379 | 3.220 | 0.504 | 0.300 | 0.002 | 0.0037 | 0.474 |

CRS: 100,000-hour estimated creep rupture strength at 550° C.
D-CRS: difference of creep rupture strength between base metal and HAZ in 100,000-hour estimated creep rupture strength at 550° C.
TZB: (Ti % + Zr %)/(BN %) value

TABLE 2

| No. | Zr | Cu | Ni | Co | P | S | O | CRS (MPa) | D-CRS (MPa) | TZB (%) | hardness of weld bond (Hv) |
|---|---|---|---|---|---|---|---|---|---|---|---|
| 1 | 0.287 | | | | 0.009 | 0.002 | 0.014 | 130 | 8 | 20.4 | 174 |
| 2 | 0.057 | | | | 0.025 | 0.007 | 0.013 | 130 | 1 | 3.7 | 197 |
| 3 | 0.019 | | | | 0.006 | 0.004 | 0.009 | 132 | 6 | 16.2 | 167 |
| 4 | 0.412 | | | | 0.026 | 0.003 | 0.001 | 134 | 2 | 16.8 | 283 |
| 5 | 0.283 | | | | 0.019 | 0.009 | 0.002 | 127 | 6 | 42.9 | 227 |
| 6 | 0.189 | | | | 0.017 | 0.003 | 0.004 | 137 | 1 | 86.6 | 253 |
| 7 | 0.497 | | | | 0.015 | 0.007 | 0.008 | 145 | 7 | 20.9 | 212 |
| 8 | 0.208 | | | | 0.017 | 0.002 | 0.009 | 122 | 4 | 25.4 | 160 |
| 9 | 0.377 | | | | 0.011 | 0.008 | 0.015 | 131 | 1 | 10.8 | 222 |
| 10 | 0.262 | | | | 0.023 | 0.003 | 0.013 | 127 | 2 | 29.6 | 214 |
| 11 | 0.306 | 0.44 | | | 0.030 | 0.009 | 0.012 | 125 | 6 | 90.0 | 287 |
| 12 | 0.291 | 1.21 | | | 0.026 | 0.006 | 0.016 | 132 | 4 | 20.2 | 210 |
| 13 | 0.071 | 0.21 | | | 0.022 | 0.005 | 0.013 | 134 | 3 | 5.9 | 259 |
| 14 | 0.402 | | 1.18 | | 0.023 | 0.010 | 0.010 | 127 | 6 | 51.1 | 264 |
| 15 | 0.263 | | 0.46 | | 0.016 | 0.003 | 0.007 | 125 | 8 | 30.2 | 209 |
| 16 | 0.289 | | 1.52 | | 0.007 | 0.002 | 0.015 | 128 | 7 | 26.4 | 260 |
| 17 | 0.142 | | | 1.91 | 0.028 | 0.002 | 0.009 | 128 | 7 | 74.8 | 188 |
| 18 | 0.159 | | | 0.21 | 0.007 | 0.002 | 0.008 | 127 | 7 | 81.3 | 166 |
| 19 | 0.278 | | | 0.36 | 0.025 | 0.009 | 0.010 | 134 | 7 | 24.8 | 278 |
| 20 | 0.249 | 0.42 | 0.33 | | 0.011 | 0.005 | 0.016 | 139 | 5 | 8.9 | 266 |
| 21 | 0.249 | | 0.48 | 1.12 | 0.023 | 0.005 | 0.017 | 134 | 5 | 30.1 | 274 |
| 22 | 0.167 | 1.12 | | 1.11 | 0.023 | 0.006 | 0.017 | 121 | 6 | 42.6 | 267 |
| 23 | 0.299 | 0.44 | 1.43 | 0.60 | 0.010 | 0.003 | 0.007 | 138 | 4 | 42.3 | 244 |

The resulting slabs were hot rolled to thick sheets having a sheet thickness of 50 mm and thin sheets having a sheet thickness of 12 mm, or hot forged into round billets. Tubes having an outer diameter 74 mm and a thickness of 10 mm were produced by hot extrusion, or pipes having an outer diameter of 380 mm and a thickness of 50 mm were produced by seamless rolling. Furthermore, the thin sheets were formed by electric resistance welding into electric resistance welded steel pipes having an outer diameter of 108 mm and a thickness of 12 mm. The working ratio was always at least 50% during hot working. The finish temperature of all of hot rolling, hot forging, hot extrusion and seamless rolling was controlled to 900 to 1,000° C. The cooling ratio of subsequent cooling, too, was set and controlled to 50° C./hr to 1,000° C./hr in accordance with the sheet thickness up to the bainite transformation finish temperature Bf point.

All the sheets and pipes were subjected to solid solution heat-treatment, and were further tempered at 700° C. for one hour.

After edge preparation was conducted in exactly the same way as in FIG. 1, circumferential joint welding was carried out between the pipes by TIG or SAW welding by processing the groove to the tube end in the circumferential direction in the same way as in FIG. 1. The weld portions were subjected to local softening annealing (PWHT) at 700° C. for 4 hours.

Figure 6A:
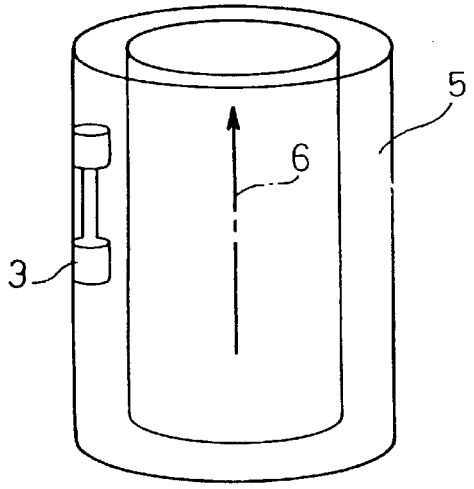
FIGS. 6(*a*) and 6(*b*) are schematic views showing a steel pipe test specimen, a steel sheet test specimen and a method of collecting a creep test specimen in an embodiment of the invention.
Figure 6B:
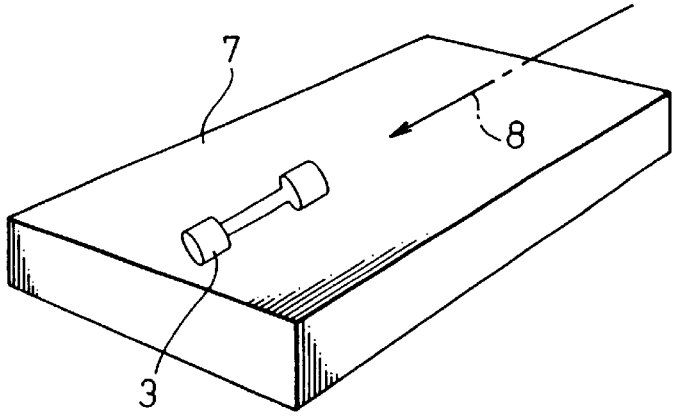

The creep properties of the base metal were measured in the following way. A creep test specimen 3 having a diameter of 6 mm was cut out from a portion other than the weld portion or the welding heat affected zone in parallel with the axial direction 6 of the steel tube 5, or in parallel with the rolling direction 8 of the sheet material 7, as shown in FIG. 6. The creep rupture strength was measured at 550° C., and the resulting data was linearly extrapolated with eye to obtain estimated creep rupture strength CRS (MPa) for 100,000 hours.

Figure 7:
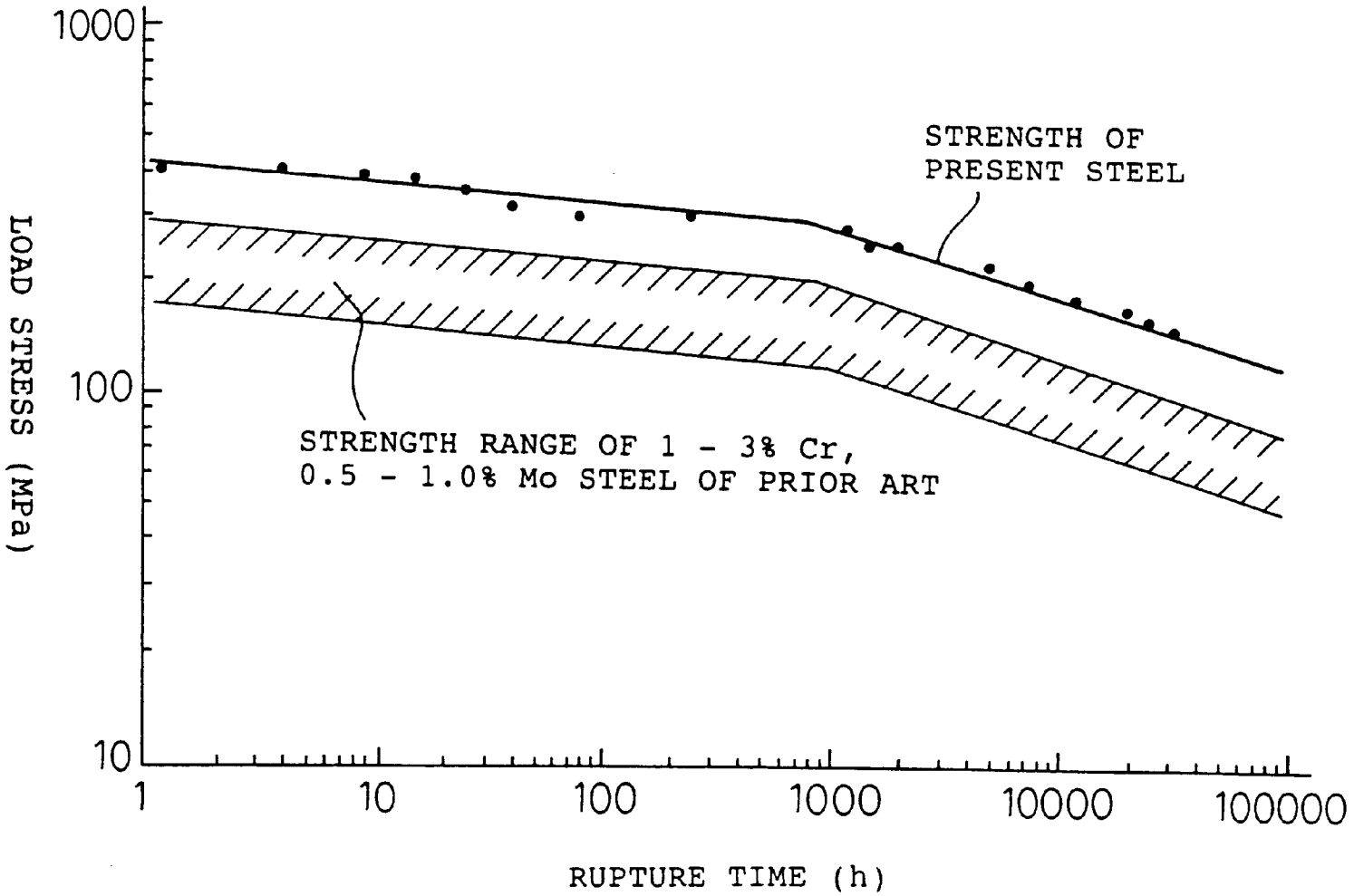
FIG. 7 is a graph showing comparatively creep rupture data at 550° C. and extrapolation line in the embodiment and creep rupture data group of conventional 1 to 3% Cr steels.

FIG. 7 shows the measurement result of the creep rupture strength of the base metal up to 10,000 hours together with the extrapolation line of the 100,000-hr estimated rupture strength. It can be seen from this graph that the high temperature creep rupture strength of the steel of the present invention was higher than that of the conventional low alloy steels, that is, 1 to 3% Cr –0.5 to 1% Mo steels.

Figure 8:
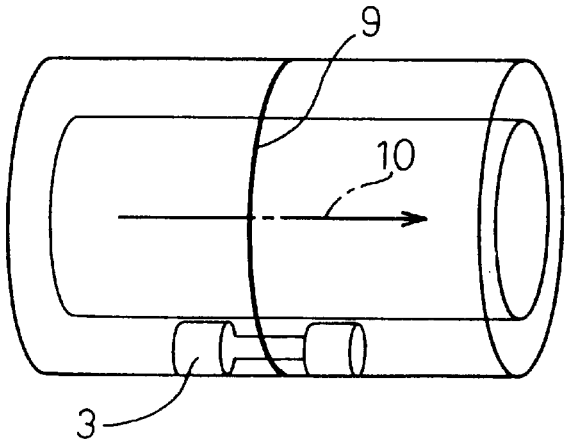
FIG. 8 is a schematic view showing a method of collecting a creep test specimen from a steel pipe test specimen welded in a circumferential direction in the embodiment of the present invention.

The creep properties of the weld portion were determined in the following way. A creep rupture test specimen 3 having a diameter of 6 mm was cut out from an orthogonal direction 10 to the weld line 9 as shown in FIG. 1 or 8. The measurement result of the rupture strength at 550° C. was linearly extrapolated up to 100,000 hours, and were comparatively evaluated with the creep properties of the base metal. The term "creep rupture strength" will be hereinafter mean the linear extrapolation estimated rupture strength for 100,000 hours at 550° C. for convenience. The difference D-CRS (MPa) of the creep linear extrapolation rupture strength between the base metal and the weld portion is used as an index of the "HAZ softening" resistance of the weld portion. The D-CRS value is somewhat affected by the collecting direction of the creep rupture test specimen to the rolling direction of the test specimen, but it has been found empirically by preliminary experiments that the influence remains within the range of 5 MPa. Therefore, the D-CRS value of not greater than 10 MPa means that the HAZ softening resistance of the material is extremely excellent.

The nitrides in the steel were analyzed and determined in the following way. Test specimens of 10 $mm^3$ were collected and after acid dissolution, the residues were extracted. After Ti, Zr, N, Nb and V contents were wet analyzed, the precipitation amounts as TiN, ZrN, NbN and VN were analyzed and determined on the basis of the working curve and thermodynamic calculation. The precipitation amount of BN was theoretically determined by regarding the remaining precipitation nitrogen content as combined with B. Incidentally, the BN precipitation amount determined by this method agreed with the actual value within an error of 10% in the steel of the present invention by preparing in advance the working curve. The mass ratio of the TiN and ZrN precipitation amounts obtained in this manner to the BN precipitation amount in terms of percent fraction was expressed by the [(TiN % +ZrN %)/(BN %)] value. This value will be hereinafter called the "TZB value" for convenience. The evaluation reference is within the range of 1 to 100 on the basis of the experimental result.

Whether or not heat-treatment after welding (PWHT) was necessary was determined by measuring the hardness of the bond of the weld joint. In the composition of the steel according to the present invention, the bainite structure exhibits the main structure. In this case, it is empirically clear that the bond preferably has a Vickers hardness of not higher than 300. Therefore, the Vickers hardness of 300 of this bond is used as the threshold value, and judgement is made to the effect that PWHT is essentially necessary when the hardness is higher than 300, and the steel is regarded as not suitable for omitting PWHT. When the hardness is less than 300, PWHT is judged as being omissible.

Tables 1 and 2 show the evaluation result of the steels of the present invention with their chemical compositions. The relationship between CRS and TZB is already shown in FIG. 2.

For comparison, the steels not corresponding to the steels of the present invention in their chemical components and the steels not corresponding to the steels of the present invention in the production method were evaluated by the same method. Tables 3 and 4 show the chemical components and CRS, D-CRS, TZB and the bond hardness as the evaluation results.

TABLE 3

| No. | C | Si | Mn | Cr | Mo | W | V | Nb | N | B | Ti |
|---|---|---|---|---|---|---|---|---|---|---|---|
| 24 | 0.072 | 0.41 | 1.48 | 1.77 | 0.47 | 0.36 | 0.851 | 0.025 | 0.002 | 0.0032 | 0.250 |
| 25 | 0.035 | 0.68 | 1.10 | 0.61 | 0.62 | 0.49 | 0.999 | 0.302 | 0.005 | 0.0010 | 0.621 |
| 26 | 0.039 | 0.73 | 1.03 | 1.12 | 1.46 | 0.92 | 0.373 | 0.343 | 0.039 | 0.0045 | 0.345 |
| 27 | 0.016 | 0.14 | 0.42 | 1.77 | 1.23 | 2.88 | 0.428 | 0.275 | 0.010 | 0.0073 | |
| 28 | 0.038 | 0.45 | 0.33 | 1.01 | 0.25 | 1.51 | 0.029 | 0.125 | 0.015 | 0.0039 | 0.073 |
| 29 | 0.016 | 0.44 | 0.66 | 1.70 | 1.42 | 0.26 | 0.172 | 0.285 | 0.056 | 0.0014 | 0.476 |
| 30 | 0.035 | 0.54 | 0.72 | 2.76 | 0.68 | 1.39 | 0.402 | 0.268 | 0.051 | 0.0068 | 0.265 |
| 31 | 0.024 | 0.23 | 1.38 | 2.47 | 0.75 | 0.08 | 0.074 | 0.145 | 0.012 | 0.0044 | 0.383 |
| 32 | 0.036 | 0.05 | 0.29 | 1.52 | 0.17 | 3.33 | 0.787 | 0.300 | 0.050 | 0.0072 | 0.329 |

CRS: 100,000-hr estimated creep rupture strength at 550° C.
D-CRS: difference of creep rupture strength between base metal and HAZ in 100,000-hr estimated creep rupture strength at 550° C.
TZB: [(Ti % + Zr %)/(BN %)] value

TABLE 4

| No. | Zr | Cu | Ni | Co | P | S | O | CRS (MPa) | D-CRS (MPa) | TZB (%) | hardness of weld bond (Hv) |
|---|---|---|---|---|---|---|---|---|---|---|---|
| 24 | 0.284 | 1.05 | 0.99 | 0.23 | 0.013 | 0.006 | 0.019 | 121 | 5 | 63 | 380 |
| 25 | 0.330 | 1.30 | 1.74 | 0.50 | 0.007 | 0.004 | 0.009 | 87 | 3 | 122 | 240 |
| 26 | 0.880 | 0.83 | 0.98 | 0.60 | 0.013 | 0.006 | 0.003 | 69 | 7 | 145 | 255 |
| 27 | 0.167 | 1.34 | 0.86 | 1.55 | 0.013 | 0.009 | 0.008 | 77 | 5 | 0.18 | 238 |
| 28 | | 0.41 | 1.88 | 1.69 | 0.018 | 0.004 | 0.011 | 48 | 2 | 0.65 | 291 |
| 29 | 0.423 | 2.50 | 0.44 | 0.61 | 0.027 | 0.004 | 0.019 | 75 | 33 | 58 | 245 |

TABLE 4-continued

| No. | Zr | Cu | Ni | Co | P | S | O | CRS (MPa) | D-CRS (MPa) | TZB (%) | hardness of weld bond (Hv) |
|---|---|---|---|---|---|---|---|---|---|---|---|
| 30 | 0.184 | 0.42 | 0.24 | 0.33 | 0.012 | 0.002 | 0.011 | 81 | 5 | 0.23 | 288 |
| 31 | 0.009 | 1.25 | 0.12 | 1.79 | 0.005 | 0.009 | 0.015 | 80 | 5 | 125 | 204 |
| 32 | 0.222 | 0.46 | 0.49 | 1.78 | 0.023 | 0.005 | 0.005 | 76 | 6 | 128 | 186 |

Figure 9:
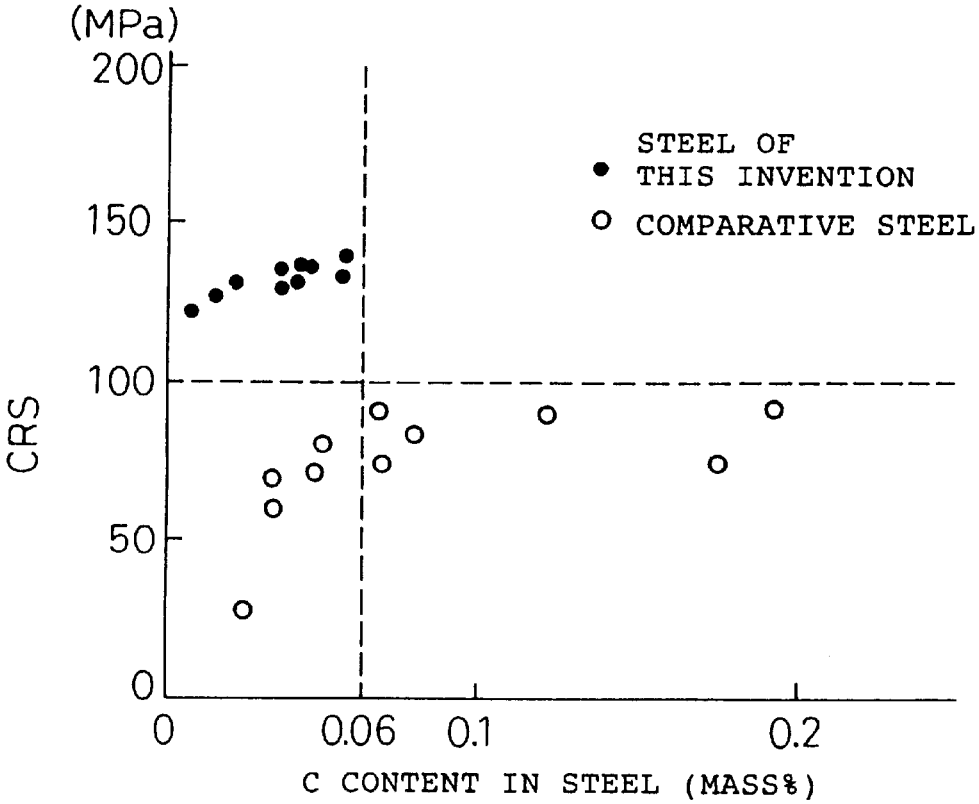
FIG. 9 is a graph showing the relation between a C content in the steel and CRS.
Figure 10:
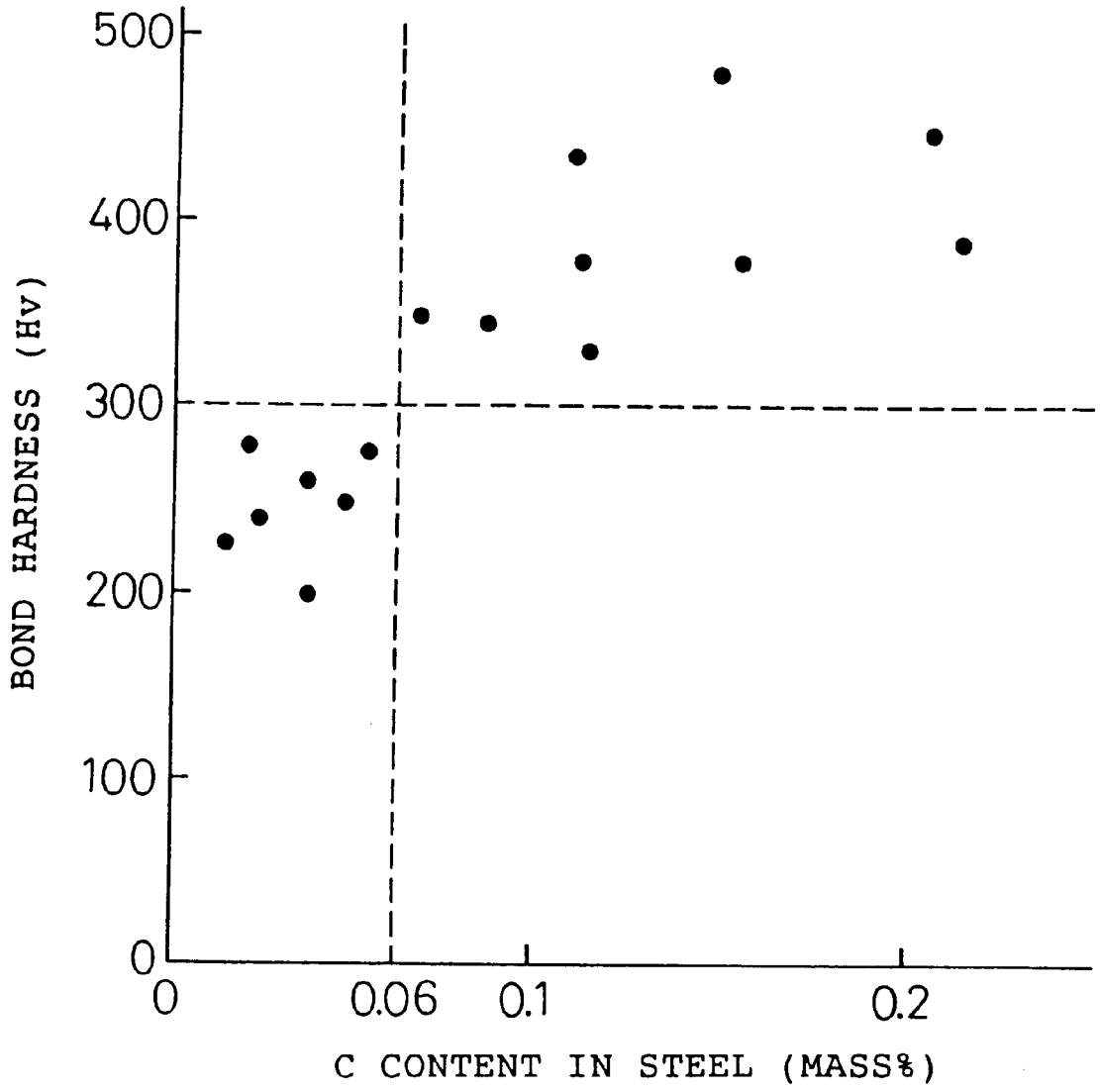
FIG. 10 is a graph showing the relation between the C content in the steel and a Vickers hardness of a as-weld bond.

FIG. 9 shows the relationship between the carbon concentrations in the steel of the present invention and in the comparative steel and the 100,000-hr estimated creep rupture strength CRS. The drop of the 100,000-hr estimated creep rupture strength was remarkable in the comparative steel with the drop of the carbon content, but this drop was small in the steel of the present invention due to precipitation strengthening of BN. FIG. 10 shows the relationship between the carbon content in the steel and the bond hardness after welding. It is obvious that the bond hardness is always lower in the steel of the present invention having a low carbon concentration. Furthermore, as shown in Tables 1 and 2, it is obvious that the steel of the present invention is excellent in the HAZ softening resistance due to positive utilization of TiN and ZrN, and due to control of the hot working finish temperature within the range of 900 to 1,000° C., and its D-CRS is always less than 10 MPa.

Among the comparative steels shown in Tables 3 and 4, the steel No. 24 represents the example where the C content was not reduced, the steel had a different composition from that of the present steel, had the bond toughness of higher than 300 after welding and could not omit PWHT. The steels Nos. 25 and 26 represent the examples where the TiN and ZrN precipitation amounts increased because Ti and Zr were added in excess, the BN precipitation amount decreased as much, and the TZB value increased eventually with the result that the precipitation strengthening by BN was lost, TiN and ZrN became coarse and did not contribute to strengthening, and the creep rupture strength of the base metal dropped. The steels Nos. 27 and 28 represent the examples where precipitation of BN increased, on the contrary, because Ti or Zr was not added, BN came coarse and did not contribute to the improvement of the creep rupture strength, and the creep rupture strength of the base metal dropped. The steel No. 29 represents the example where the creep rupture strength dropped because Cu was added in excess, and the HAZ softening resistance, too, dropped. The steel No. 30 represents the example where the hot rolling finish temperature was set to 850° C., the TZB value dropped less than 1 consequently, and the creep rupture strength of the base metal dropped. The steels Nos. 31 and 32 represent the examples where the TZB value exceeded 100 because the hot forging finish temperatures were 1,050° C. and 1,080° C., respectively, and consequently, BN precipitation strengthening could not be utilized effectively and the base metal strength dropped.

Industrial Applicability

The present invention can provide a ferritic heat-resistant steel which is excellent in a HAZ softening resistance, has a high creep strength and a high HAZ softening resistance at a high temperature of 500° C. or above, and can omit heat-treatment after welding.

We claim:

1. A ferritic heat-resistant steel excellent in HAZ softening resistance and capable of omitting heat-treatment after welding, containing, in terms of mass %:

C: 0.01 to 0.06%,

Si: 0.02 to 0.80%,

Mn: 0.20 to 1.50%,

Cr: 0.50 to 3.00%,

Mo: 0.01 to 1.50%,

W: 0.01 to 3.50%,

V: 0.02 to 1.00%,

Nb: 0.01 to 0.50%,

N: 0.01 to 0.06%,

B: 0.0003 to 0.008%,

Ti: 0.001 to 0.5%,

Zr: 0.001 to 0.5%, limiting the contents of the following components:

P: to not greater than 0.030%,

S: to not greater than 0.010%, and

O: to not greater than 0.020%, and containing the balance consisting of Fe and unavoidable impurities;

wherein a weight ratio of TiN and BN in said steel is controlled to 1 to 100 in terms of a value (TiN % +ZrN %)/(BN %), and a mean grain diameter of BN is not greater than 1 $\mu$m.

2. A ferritic heat-resistant steel excellent in HAZ softening resistance and capable of omitting heat-treatment after welding, containing, in terms of mass %:

C: 0.01 to 0.06%,

Si: 0.02 to 0.80%,

Mn: 0.20 to 1.5%,

Cr: 0.50 to 3.00%,

Mo: 0.01 to 1.50%,

W: 0.01 to 3.50%,

V: 0.02 to 1.00%,

Nb: 0.01 to 0.50%,

N: 0.001 to 0.06%,

B: 0.0003 to 0.008%,

Ti: 0.001 to 0.5%,

Zr: 0.001 to 0.5%, containing further at least one of the following members either individually or in combination:

Cu: 0.1 to 2.0%,

Ni: 0.1 to 2.0%, and

Co: 0.1 to 2.0%, limiting the contents of the following components:

P: to not greater than 0.030%,

S: to not greater than 0.010%, and

O: to not greater than 0.020%, and containing the balance consisting of Fe and unavoidable impurities;

wherein a weight ratio of TiN and BN in said steel is controlled to 1 to 100 in terms of a value (TiN % +ZrN %)/(BN %), and a mean grain diameter of BN is not greater than 1 $\mu$m.

3. A method of producing a ferritic heat-resistant steel excellent in HAZ softening resistance and capable of omitting heat-treatment after welding, characterized in that when a steel having the following composition is hot rolled or hot forged, a working ratio of rolling or forging is at least 50%, said working is finished at a temperature between 900 and 1,000° C., and a cooling rate immediately after said hot working is set to 50° C./hr to 1,000° C./hr up to a bainite transformation temperature so that a weight ratio of TiN and BN in said steel is controlled to 1 to 100 in terms of a value (TiN +ZrN %)/(BN %), and a mean grain diameter of BN is not greater than 1 μm:

C: 0.01 to 0.06%,

Si: 0.02 to 0.80%,

Mn: 0.20 to 1.50%,

Cr: 0.50 to 3.00%,

Mo: 0.01 to 1.50%,

W: 0.01 to 3.50%,

V: 0.02 to 1.0%,

Nb: 0.01 to 0.50%,

N: 0.01 to 0.06%,

B: 0.0003 to 0.008%,

Ti: 0.001 to 0.5%,

Zr: 0.001 to 0.5%, and limiting the contents of the following components:

P: to not greater than 0.030%,

S: to not greater than 0.010%, and

O: to not greater than 0.020%.

4. A method of producing a ferritic heat-resistant steel excellent in HAZ softening resistance and capable of omitting heat-treatment after welding, characterized in that when a steel having the following composition is hot rolled or hot forged, a hot working ratio of rolling or forging is at least 50%, said working is finished at a temperature between 900 and 1,000° C., and a cooling rate immediately after said hot working is set to 50° C./hr to 1,000° C./hr up to a bainite transformation temperature so that a weight ratio of TiN and BN in said steel is controlled to 1 to 100 in terms of a value (TiN +ZrN %)/(BN %), and a mean grain diameter of BN is not greater than 1 μm:

C: 0.01 to 0.06%,

Si: 0.02 to 0.80%,

Mn: 0.20 to 1.50%,

Cr: 0.50 to 3.00%,

Mo: 0.01 to 1.50%,

W: 0.01 to 3.50%,

V: 0.02 to 1.00%,

Nb: 0.01 to 0.50%,

N: 0.001 to 0.06%,

B: 0.0003 to 0.008%,

Ti: 0.001 to 0.5%,

Zr: 0.001 to 0.5%, containing further at least one of the following members either individually or in combination:

Cu: 0.1 to 2.0%,

Ni: 0.1 to 2.0%, and

Co: 0.1 to 2.0%, and limiting the contents of the following components:

P: to not greater than 0.030%,

S: to not greater than 0.010%, and

O: to not greater than 0.020%.

* * * * *